United States Patent [19]

Dutt et al.

[11] Patent Number: 4,856,665

[45] Date of Patent: Aug. 15, 1989

[54] TAMPER EVIDENT CLOSURE WITH HOOK-LIKE LOCKING TABS

[75] Inventors: Herbert V. Dutt, Sarasota, Fla.; Duane H. Lewis, Claysville, Pa.

[73] Assignee: Continental Plastics, Inc., Triadelphia, W. Va.

[21] Appl. No.: 284,959

[22] Filed: Dec. 15, 1988

[51] Int. Cl.[4] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,197,955 | 4/1980 | Luenser | 215/252 |
| 4,394,918 | 7/1983 | Grasson | 215/252 X |
| 4,506,795 | 3/1983 | Herr | 215/252 |
| 4,511,054 | 4/1983 | Shank | 215/252 |
| 4,519,516 | 5/1985 | Amos | 215/252 |
| 4,550,844 | 11/1985 | Lininger | 215/252 |

*Primary Examiner*—Donald F. Norton

*Attorney, Agent, or Firm*—Richard V. Westerhoff

[57] ABSTRACT

A tamper evident closure has frangible bridges detachably connecting a tamper indicating band to the skirt of a cap, and hook-like locking tabs for securing the tamper indicating band to a transfer bead on a container, circumferentially displaced from one another and all aligned with a radially extending annular gap between the tamper indicating band and the cap, such that the closure can be integrally molded from thermoplastic material in a straight draw mold without slides, inserts or post molding operations. The frangible bridges extend along, as well as across, the annular gap and are flexible so that the tamper indicating band can be extended axially relative to the cap to accommodate for variations in dimensions and tolerances in containers to which the closure is applied.

14 Claims, 3 Drawing Sheets

TAMPER EVIDENT CLOSURE WITH HOOK-LIKE LOCKING TABS

RELATED APPLICATION

My commonly owned U.S. Pat. application Ser. No. 276,655 filed on Nov. 23, 1988.

BACKGROUND

1. Field of the Invention

This invention relates to container closures which provide evidence of tampering. More particularly, it relates to such closures having a tamper indicating band secured to a radial flange on a container neck by hook like locking tabs and connected to a cap by extendable bridges which fracture upon removal of the cap. The invention also relates to such caps which can be molded with straight draw molding techniques without the need for slides or inserts.

2. Background Information

It is common practice today to provide container closures with devices which indicate whether the closure has been opened or tampered with. A common type of such closures utilizes an annular ring or tamper indicting band which is connected to a conventional cap, such as a screw cap, by frangible connecting ribs or bridges. The tamper indicating band is secured to the container, such that when the cap is removed, the connecting ribs or bridges fracture to provide a positive, visual and mechanical indication of cap removal or tampering.

A common arrangement for securing the tamper indicating band to the container is to provide a radially inwardly directed flange or fingers which engage a radially outwardly projecting flange on the container neck, commonly known as a transfer bead because the container is often transported by devices which lift the container by this flange. One drawback of such tamper evident closures is that they create undercuts. Closures with such undercuts cannot be integrally molded using a straight draw mold. That is, a mold in which all of the features of the molded product are embodied in two halves of the mold which can merely be pulled apart. In order to incorporate the undercuts, lateral slides are typically used in the mold, which complicates both the mold and the molding process.

In some closures, the tamper indicating band is secured to the transfer bead on the container by hook-like locking tabs which project axially, as well as radially inward, from the tamper indicating band. Examples of such closures are shown in U.S. Pat. Nos. 4,394,918; 4,550,844; and 4,506,795. The closures of these patents require lateral slides to mold the hook-like locking tabs, and/or, post molding steps to form the hook in the tab. These closures also require lateral slides or post molding steps to form the frangible section along which the tamper indicating band separates from the cap as the cap is removed from the container or tampered with. Such lateral mold slides and post molding steps add cost and time to the production of tamper evident closures.

There is a need, therefore, for an improved closure with a tamper indicating band for engaging a transfer bead on a container which can be integrally molded in a straight draw mold without slides or inserts.

There is a further need for such a closure which has the improved gripping capability provided by hook-like locking tabs which engage the transfer bead on the container.

There is also a need for such a closure which does not require post molding operations.

There is an additional need for such a closure having flexible frangible bridges connecting the tamper indicating band to the remainder of the closure so that the closure may be used with containers having variable spacing between the threads securing the cap to the container and the transfer bead, and so that tolerances in the dimensions on the closure and container can be loose.

There is a related need for such a closure having arrangements for applying the force required to push the locking tabs on the tamper indicating band past the transfer bead without overstressing the frangible bridges connecting the tamper indicating band to the cap.

SUMMARY OF THE INVENTION

These and other needs are satisfied by the invention which is directed to a closure having a tamper indicating band secured to the transfer bead of a container by hook-like locking tabs which extend axially toward the cap as well as radially inward, and frangible bridges connecting the tamper band to the closure cap, yet can be integrally molded in a straight draw mold without lateral slides or inserts. The annular tamper indicating band is a hollow cylindrical member which has an inner diameter which is at least as great as the outer diameter of the transfer bead and greater than the outer diameter of the cap portion of the closure to form an annular gap between the tamper indicating band and the cap. Circumferentially spaced frangible bridges span the gap to detachably connect the tamper indicating band to the cap. Locking tabs extend from the tamper indicating band axially toward the cap and radially inward to form "hooks" for engaging the transfer bead. The locking tabs terminate in end portions defining a circle having a diameter less than the inner diameter of the tamper indicating band but greater than the outer diameter of the skirt of the cap. The locking tabs are circumferentially spaced from the frangible bridges.

With this arrangement, the locking tabs deflect outward to pass over the transfer bead as the closure is applied to a container and then spring inward so that they are in position to engage the transfer bead and secure the tamper indicating band to the container as the cap is removed, resulting in fracture of the frangible bridges.

The closure of the invention can be integrally molded in a straight draw mold without slides or inserts despite having frangible bridges and hook-like locking tabs, because there are no discontinuous axially aligned parts. The undercut produced by the hook-like locking tabs can be formed by extensions on one mold half which project axially through the annular gap between the tamper indicating band and the cap skirt. This is possible because the locking tabs are circumferentially displaced relative to the frangible bridges extending across this gap to join the tamper indicating band to the cap, and because the locking tabs do not extend radially inward as far as the outer diameter of the cap skirt.

In the preferred form of the invention, the frangible bridges are flexible members which extend a distance around the annular gap and can be flexed to allow axial displacement of the tamper indicating band relative to the cap to accommodate for tolerances and variations in the distance between the threads and transfer beads on different containers. Still though, these flexible members are circumferentially displaced from the locking tabs in the gap between the tamper indicating band and the cap so that this preferred form of the closure can be integrally molded in a straight draw mold.

Also in the preferred embodiment of the invention, the closure is molded with the flexible members comprising the frangible bridges in a first unstressed position. The bridges are flexed to a second stressed condition to engage the locking tabs on the transfer bead on the container. Hence, when the bridges are fractured, they return to the first unstressed position. This produces a positive separation between the fractured parts which provides a clear visual and mechanical indication that the closure has been opened or tampered with.

The invention encompasses both the closure and the closure system which combines the closure with a container.

BRIEF DESCRIPTION OF THE DRAWINGS

A full understanding of the invention can be gained from the following description of the preferred embodiment when read in conjunction with the accompanying drawings in which:

FIG. 5 is a composite elevation view with part in section and part cut away of the closure of FIGS. 1 through 3 in place on a container, and showing in the left half the frangible bridges of the closure intact, and in the right half showing the bridges fractured indicating that the closure has been tampered with.

DESCRIPTION OF THE PREFERRED EMBODIMENT

Figure 1:
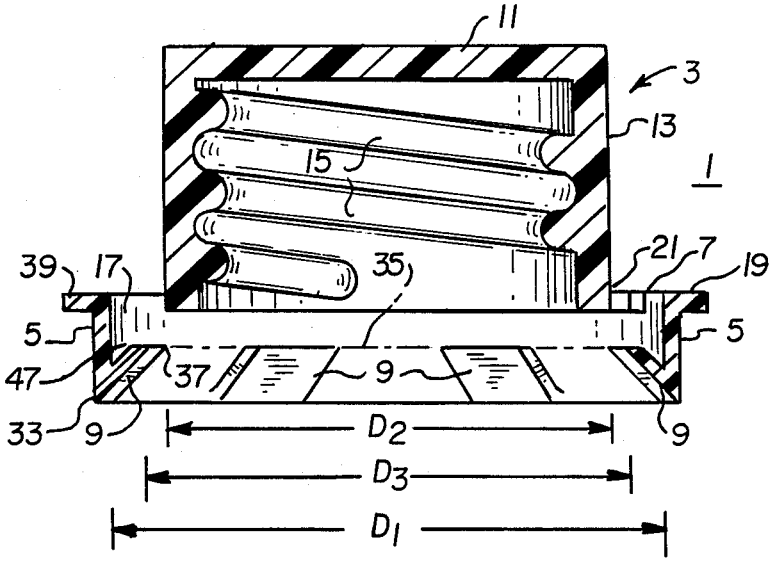
FIG. 1 is a vertical section taken along the line 1—1 in FIG. 2 through a closure in accordance with the invention.
Figure 2:
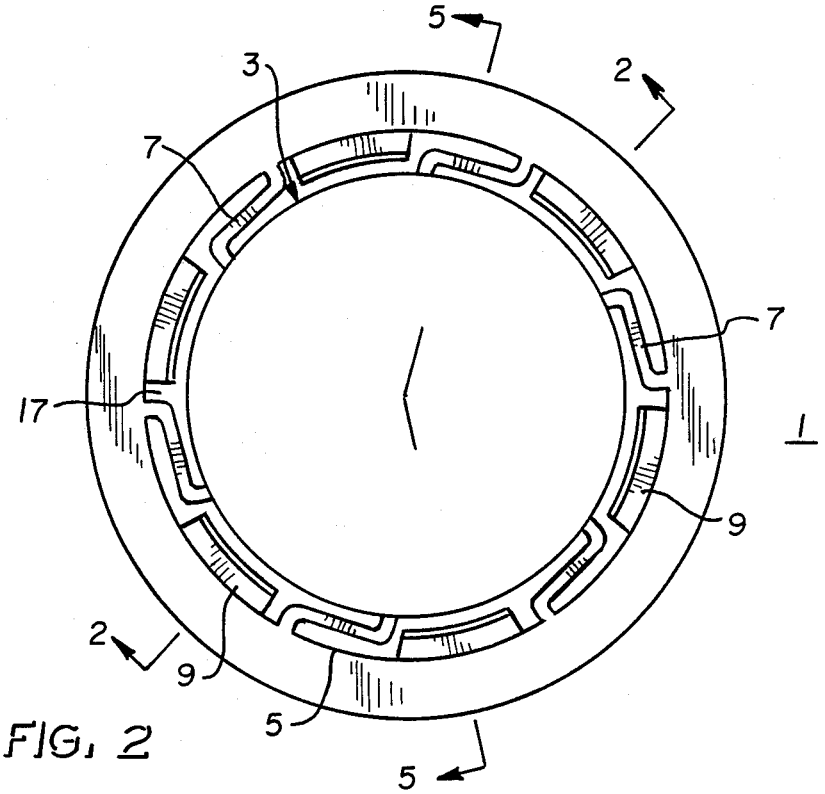
FIG. 2 is a plan view of the closure of FIG. 1.
Figure 3:
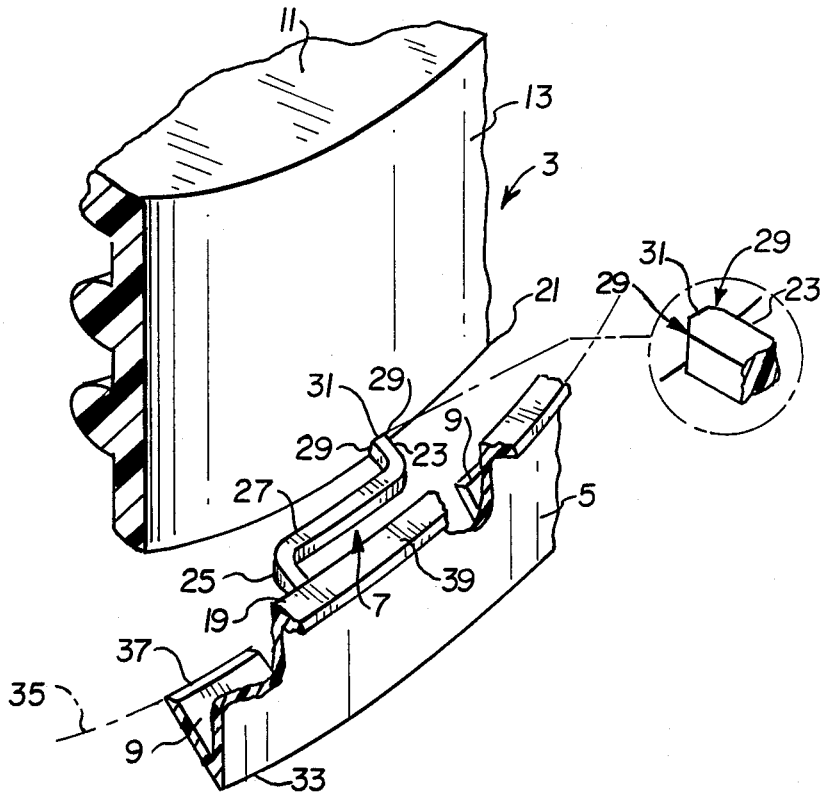
FIG. 3 is an isometric view of a cutaway portion of the closure of FIGS. 1 and 2.

Referring to FIG. 1 through 3, the closure 1 of the invention includes a cap 3, an annular tamper indicating band 5, a plurality of frangible bridges 7 detachably securing the tamper indicating band 5 to the cap 3, and a number of locking tabs 9 extending from the tamper indicating band.

The cap 3 includes a circular end wall 11 and an annular skirt 13 extending axially from the end wall. The skirt 13 is provided internally with an engagement member for engaging a container, such as the internal threads 15, although other engagement members such as an annular bead could be used.

The annular tamper indicating band 5 is a hollow cylindrical member having an inner diameter $D_1$ which is greater than the outer diameter $D_2$ of the cap 3, thereby forming an annular gap 17 therebetween. The frangible bridges 7 extend from a first end 19 of the tamper indicating band 5 across the gap 17 to the free end 21 of the skirt 13. The frangible bridges 7 are circumferentially, and preferably evenly, spaced around the gap 17.

In the preferred form of the invention illustrated, the frangible bridges 7 are flexible members which permit axial extension of the tamper indicating band 5 relative to the cap 3. To this end, the bridges 7 each include a first end section 23 extending radially outward from the skirt 13, a second end section 25 extending radially inward from the tamper indicating band 5 and circumferentially displaced from the first end section, and an intermediate section 27 extending along the gap 17 between the first and second end sections 23 and 25. Notches 29 reduce the cross-section of the first end section 23 of each of the bridges 7 at their intersection 31 with the skirt 13. It is along this intersection 31 of reduced cross-section that the frangible bridges 7 fracture, as will be seen. While it is preferred that the frangible bridges 7 fracture at the intersection with the skirt 13, they can be made to fracture at any location along their length or at the intersection with the tamper indicating band 5.

The locking tabs 9 extend axially toward the cap 3 and radially inward from the second end 33 of the tamper indicating band 5. The locking tabs 9 extend radially inward a distance such that the diameter $D_3$ of an imaginary circle 35 defined by the end portions 37 of the locking tabs 9 is greater than the outer diameter $D_2$ of the cap 3. This is an important feature in that it means that the locking tabs are axially aligned with the gap 17. It is also important that the locking tabs 9 are circumferentially spaced from the frangible bridges 7. The locking tabs 9 and frangible bridges 7 preferably alternate circumferentially around the closure 1.

A flange 39 extends radially outward from, and preferably continuously all the way around, the first end 19 of the tamper indicating band 5. The flange 39 stiffens the tamper indicating band 5, and as will be discussed more fully, provides a location for the application of force to press the locking tabs 9 over the transfer bead on a container without applying undue stress to the frangible bridges 7.

Figure 4:
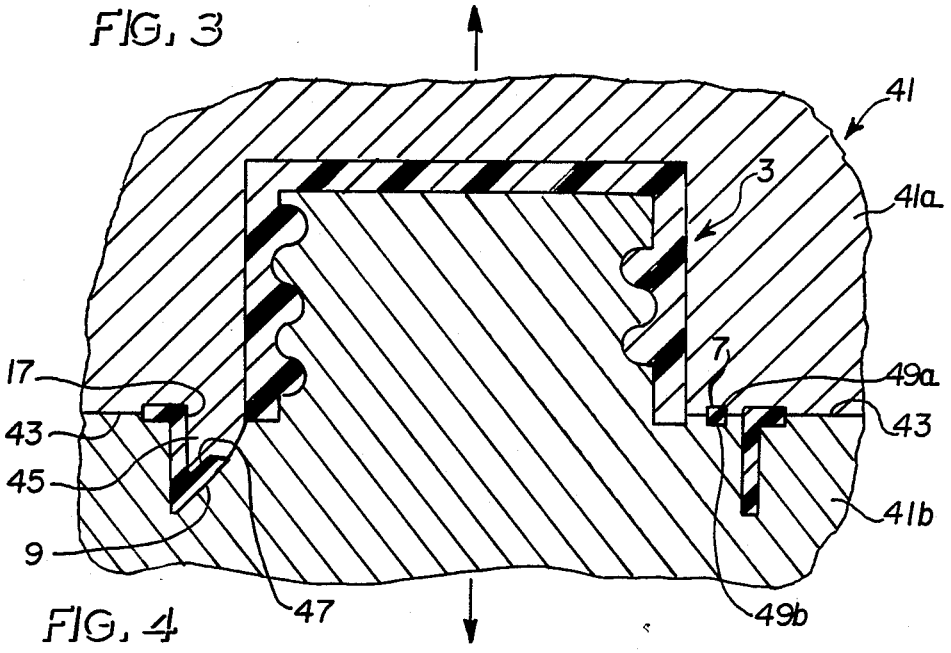
FIG. 4 is a vertical section through a mold in which the closure of FIGS. 1 and 2 is integrally formed and is taken along the line 4—4 in FIG. 2.

The closure 1 is designed to be integrally molded in one piece. As will be seen from FIG. 4, the mold 41 includes two halves **41*a* and 41*b* which meet at a parting line 43. Projections 45 on the upper half 41*a* of the mold 41 extend through the gap 17 to define the recesses 47 behind the locking tabs 9. The frangible bridges 7 are formed by recesses in confronting portions 49*a* and 49*b* of the two mold halves 41*a* and 41*b* respectively. It can be appreciated from FIG. 4, that all of the elements of the closure 1 are formed by the two halves of the mold 41 which are drawn straight away from each other, in the direction of the arrows, to release the completed closure. No slides, inserts or post molding operations are required to complete the closure. Hence, the closures can be produced rapidly and economically, preferably several at a time in a multiple cavity mold. The closures are injection molded of any suitable thermoplastic material, such as the preferred material, polypropylene. The closure 1** can be molded without slides or inserts because there are no discontinuous portions of the closure which are axially aligned.

Figure 5:
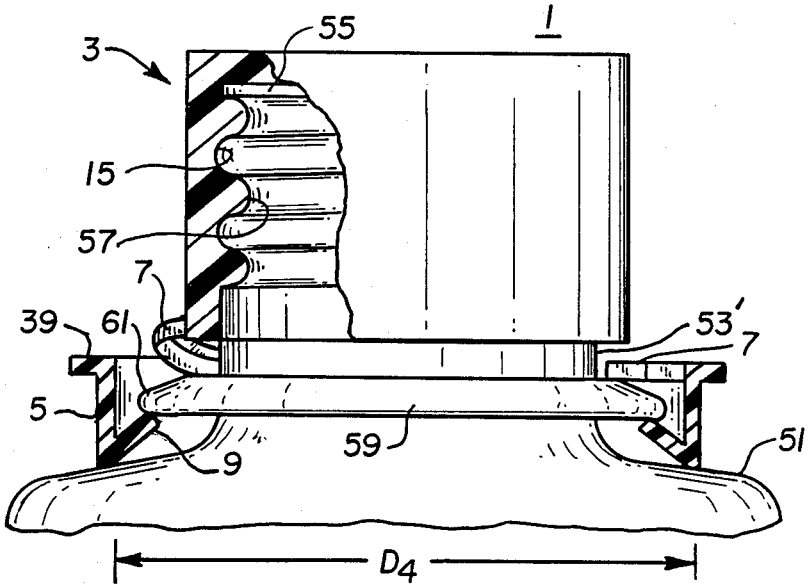

FIG. 5 is a composite view illustrating a closure 1 as applied to a container 51 and still intact, as shown in the left half of the figure, and after the cap has been loosened or tampered with, as illustrated in the right half of the figure.

The container 51 includes a neck portion 53 which defines a container opening 55. External threads 57 on the neck portion 53 are complementary to the internal threads 15 in the cap skirt 13. A flange 59, such as a transfer bead, extends radially outward from the neck portion 53 below the threads 57, and may have a tapered upper surface 61.

Figure 6:
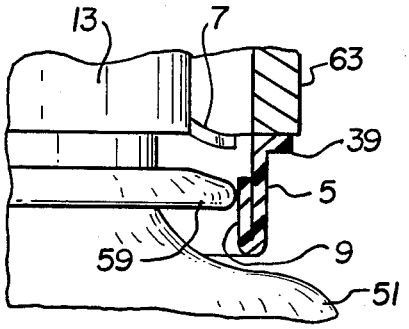
FIG. 6 is a fragmentary view, partially in section, illustrating the closure of FIGS. 1 through 3 as it is being applied to a container.

The closure 1 is applied to the container 51 by engaging the threads 15 on the skirt 13 with the threads 57 on the neck portion 53. The tamper indicating band 5 is extended axially relative to the cap 3 by, for instance, a collar 63 on a capping machine (not shown) which engages the flange 39 and presses the tamper indicating band 5 downward. This brings the locking tabs 9 into contact with the radial flange or transfer bead 59 on the container, which deflects them radially outward until they pass over the transfer bead 59, as shown in FIG. 6. The locking tabs then spring inward to their original position due to their resilience. The inner diameter $D_1$ of the tamper indicating band 5 is at least as great as the outer diameter $D_4$ of the radial bead 59, while the diameter $D_3$ of the circle 35 defined by the ends 37 of the undeflected locking tabs 9 is smaller than the outer diameter $D_4$ of the bead 59. Thus, when the cap 3 is unscrewed, and moves axially up the container neck 53, the tamper indicating band 5 is retained by the engagement of the locking tabs 9 under the radial bead 59. This puts the frangible bridges 7 in tension until they fracture along the intersections 31 with the cap skirt 13.

The tamper indicating band 5 remains secured to the container when the cap is removed, as illustrated in the right hand side of FIG. 5. The closure 1 is molded with the frangible bridges 7 set in a first position extending radially outward from the free end 21 of the skirt 13 on the cap 3, as illustrated in FIG. 1. The bridges 7 are flexed to a second position, such as shown in the left side of FIG. 5, when the closure 1 is applied to a container 51. When the bridges fracture at the intersection 31 with the skirt 13, the set causes them to return to the first position relative to the tamper indicating band 5 in which they were molded, as shown in the right side of FIG. 5. This positive separation of the bridges from the skirt 13 of the cap 3 provides an indication, visible at a glance, that they have been fractured.

The closure of the invention is easily and economically molded without slides, inserts or post molding operations, is easily applied to a container with wide variations in dimensions and tolerances, and provides a clear, visible indication that the closure has been tampered with.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A tamper indicating closure for a container having a neck portion defining a container opening, external engagement means on said neck portion for receiving and retaining the closure, and a radial bead on the neck portion spaced from said opening by said engagement means, and having a preset outer diameter, said closure comprising:

a cap having an end wall and a cylindrical skirt extending axially from the end wall and terminating in a free end having a predetermined outer diameter, said skirt having internal engagement means complimentary to the external engagement means on the neck portion of the container for selectively securing the cap to the container to close said container opening;

an annular tamper indicating band having an inner diameter at least as great as the preset outer diameter of the radial bead on the container and greater than the outer diameter of the free end of the skirt, forming an annular gap between the free end of the skirt and the tamper indicating band, a plurality of circumferentially spaced frangible bridges extending across said gap and detachably securing said tamper indicating band to said skirt; and a number of locking tabs extending from said tamper indicating band axially toward said cap and radially inward and terminating in end portions defining a circle having a diameter less than the outer diameter of said radial bead on the container but greater than the outer diameter of said skirt, said locking tabs being circumferentially spaced from the frangible bridges and deflecting outward to pass over the radial bead as the closure is applied to the container and then springing inward, whereby the tamper indicating band is secured to the container by engagement of the locking tabs with said radial bead, and said frangible bridges fracture as said cap is removed.

2. The closure of claim 1 including radially outwardly extending flange means on said tamper indicating band.

3. The closure of claim 2 wherein said radially outwardly extending flange means is a continuous annular flange.

4. The closure of claim 1 wherein said frangible bridges comprise flexible members which permit axial displacement of said tamper indicating band with respect to said cap without fracturing but which fracture when said cap is removed.

5. The closure of claim 4 including flange means extending radially outwardly from said tamper indicating band.

6. The closure of claim 4 wherein the flexible members each comprise first and second circumferentially spaced end sections connected to the skirt of the cap and the tamper indicating band respectively, and an intermediate section extending along said annular groove between said first and second sections.

7. The closure of claim 6 wherein the first section of each of said flexible members is of reduced cross-section at which said flexible member fractures when said cap is removed, wherein said closure is molded with said flexible members in a preset position relative to said tamper indicating band and wherein said flexible members are flexed from said preset position to engage said locking tabs with said radial bead, and wherein said flexible members return toward said preset position relative to said tamper indicating band when said flexible members fracture at said reduced cross-section.

8. A closure system comprising:

a container having:

a neck portion defining a container opening;

external threads on said neck portion; and a radial bead on said neck portion spaced from said opening by said external threads and having a preset outer diameter; and a closure including:

a cap having:

an end wall;

an annular skirt having a predetermined outer diameter extending axially from the end wall and terminating in a free end; and internal threads on said annular skirt complimentary to the external threads on the neck portion of the container;

a hollow cylindrical tamper indicating band having an inner diameter at least as great as said preset outer diameter of the radial bead on said neck portion of the container and greater than said outer diameter of said skirt of said cap to form an annular gap between said free end of the skirt and the tamper band, said hollow cylindrical tamper indicating band having first and second ends;

a plurality of circumferentially spaced, frangible bridges- spanning said gap and detachably connecting the tamper indicating band at about said first end thereof to said cap at about said free end of said skirt; and a number of locking tabs extending from said tamper indicating band axially toward said cap and radially inward and terminating in end portions defining a circle having a diameter less than the outer diameter of said radial bead on the container but greater than the outer diameter of said skirt, said locking tabs being circumferentially spaced from the frangible bridges and deflecting outward to pass over the radial bead as the closure is applied to the container and then springing inward, whereby the tamper indicating band is secured to the container by engagement of the locking tabs with said radial bead, and said frangible bridges fracture as said cap is removed.

9. The closure system of claim 8 including flange means extending radially outward from said tamper indicating band.

10. The closure system of claim 9 wherein said flange means extends radially outward from about the first end of said tamper indicating band.

11. The closure system of claim 10 wherein said flange means is a continuous annular flange extending radially outward from the first end of the tamper indicating band.

12. The closure system of claim 10 wherein said frangible bridges comprise flexible members which permit axial displacement of said tamper indicating band with respect to said cap without fracturing but which fracture when said cap is unscrewed.

13. The closure system of claim 12 wherein each of said flexible members comprise first and second circumferentially spaced sections connected to the skirt and tamper indicating band respectively and an intermediate section extending along said gap between said first and second sections.

14. The closure system of claim 13 wherein said closure is integrally molded with said flexible members set in a first position and wherein said flexible members are flexed to a second position to engage said locking tabs on the radial flange of said container, said flexible members returning to said first position upon fracturing of the bridges with removal of the closure.

* * * * *